US006125762A

United States Patent [19]

Fritz et al.

[11] Patent Number: 6,125,762

[45] Date of Patent: Oct. 3, 2000

[54] FLAT-FORM SEPARATION DEVICES

[75] Inventors: James E. Fritz, Ellington; Steven L. Olson, West Hartford; Jon E. Rydberg, Avon, all of Conn.

[73] Assignee: The Ensign-Bickford Company, Simsbury, Conn.

[21] Appl. No.: 09/108,161

[22] Filed: Jun. 30, 1998

Related U.S. Application Data

[60] Provisional application No. 60/051,689, Jul. 3, 1997.

[51] Int. Cl.[7] ..... F42B 15/38

[52] U.S. Cl. ..... 102/378; 89/1.14

[58] Field of Search ..... 102/377, 378; 89/1.14, 1.57; 285/4; 24/602

[56] References Cited

U.S. PATENT DOCUMENTS

| | | | |
|---|---|---|---|
| 845,374 | 2/1907 | Reed | 102/27 |
| 1,950,947 | 3/1934 | Mulroyan | 285/203 |
| 2,516,689 | 7/1950 | France et al. | 138/64 |
| 3,084,597 | 4/1963 | Beyer | 89/1 |
| 3,087,369 | 4/1963 | Butterfield | 85/1 |
| 3,185,090 | 5/1965 | Weber | 102/24 |
| 3,290,770 | 12/1966 | Silverman et al. | 29/421 |
| 3,290,771 | 12/1966 | Silverman et al. | 29/421 |
| 3,311,056 | 3/1967 | Noddin | 102/27 |
| 3,343,248 | 9/1967 | Silverman et al. | 29/200 |
| 3,362,290 | 1/1968 | Carr et al. | 89/1 |
| 3,373,686 | 3/1968 | Blain et al. | 102/22 |
| 3,486,410 | 12/1969 | Drexelius et al. | 89/1 |
| 3,530,759 | 9/1970 | Francis | 85/1 |
| 3,633,456 | 1/1972 | Carr et al. | 89/1 B |
| 3,693,247 | 9/1972 | Brown | 29/512 |
| 3,698,281 | 10/1972 | Brandt et al. | 89/1 B |
| 3,833,984 | 9/1974 | Dietzel | 29/157 R |
| 3,929,072 | 12/1975 | Zapf | 102/27 R |
| 4,022,129 | 5/1977 | Day et al. | 102/49.5 |
| 4,106,875 | 8/1978 | Jewett | 403/2 |
| 4,137,848 | 2/1979 | Cunha | 102/49.5 |
| 4,176,607 | 12/1979 | Kishi et al. | 102/374 |
| 4,493,241 | 1/1985 | Oliva et al. | 89/1.14 |
| 4,664,033 | 5/1987 | Burkdoll et al. | 102/275.2 |

(List continued on next page.)

FOREIGN PATENT DOCUMENTS

| | | |
|---|---|---|
| 0 246 958 | 11/1987 | European Pat. Off. . |
| 0 273 061 | 7/1988 | European Pat. Off. . |
| 0 472 453 | 2/1992 | European Pat. Off. . |

OTHER PUBLICATIONS

E. Raymond Lake, "Confined Explosive Separation System", McDonnell Aircraft Company, pp. 1–6; Jun. 1969.

V. Noel, "Sure–Sep Separation System", MDC H5185, pp. 1–5, Oct. 1989.

S. Renfro et al, AIAA 93–2063, "Development and Modeling of a More Efficient Frangible Separation Joint", pp. 1–8, Jun. 1993.

*Primary Examiner*—Harold J. Tudor

*Attorney, Agent, or Firm*—Libert & Associates

[57] ABSTRACT

A flat-form separation device (12) is made of two half-section members (22, 22') which are fastened together by a series of fasteners (38) to define therebetween a receiving channel within which an expansion device (40) is received. Aside from the receiving channel and any apertures which are to receive mechanical fasteners, the separation device (12) is solid throughout and free of other channels or cavities. The device (12) includes a pair of joinder flanges formed by mating half-flange segments (28*a* and 28*b*), which contain apertures (32 and 34) by which the flat-form separation device (12) may be secured to structures (48, 50) which are to be temporarily joined by the device (12). Because of the cross-sectional profile of the half-section members (22, 22'), they may be made by manufacturing techniques, such as machining, which enable the use of alloys or metals which are much tougher and stronger than those which can be extraded to form prior art hollow-form separation devices (14). Several embodiments of the flat-form separation device (12) are disclosed. Both flat-form separation devices (12) and hollow-form separation devices (14) may be combined in a segmented separation structure (10).

22 Claims, 8 Drawing Sheets

U.S. PATENT DOCUMENTS

| | | | |
|---|---|---|---|
| 4,685,376 | 8/1987 | Noel et al. | 89/1.14 |
| 4,742,773 | 5/1988 | Bartholomew et al. | 102/275.3 |
| 4,825,764 | 5/1989 | Jullien | 102/202.14 |
| 4,879,941 | 11/1989 | Repé et al. | 89/1.14 |
| 5,010,823 | 4/1991 | Morrison | 102/307 |
| 5,109,749 | 5/1992 | Olcer | 89/1.14 |
| 5,123,356 | 6/1992 | Brooks et al. | 102/275.12 |
| 5,129,306 | 7/1992 | Fauvel | 89/1.14 |
| 5,147,976 | 9/1992 | Laurensou et al. | 102/275.3 |
| 5,327,835 | 7/1994 | Adams et al. | 102/275.11 |
| 5,331,894 | 7/1994 | Wassell et al. | 102/275.12 |
| 5,365,851 | 11/1994 | Shaw | 102/275.6 |
| 5,372,071 | 12/1994 | Richards et al. | 102/378 |
| 5,390,606 | 2/1995 | Harris | 102/378 |
| 5,392,684 | 2/1995 | Renfro et al. | 89/1.14 |
| 5,402,720 | 4/1995 | Bottorff et al. | 102/378 |
| 5,417,162 | 5/1995 | Adams et al. | 102/317 |
| 5,423,263 | 6/1995 | Rontey et al. | 102/275.12 |
| 5,898,123 | 4/1999 | Fritz et al. | 102/378 |

FIG. 1
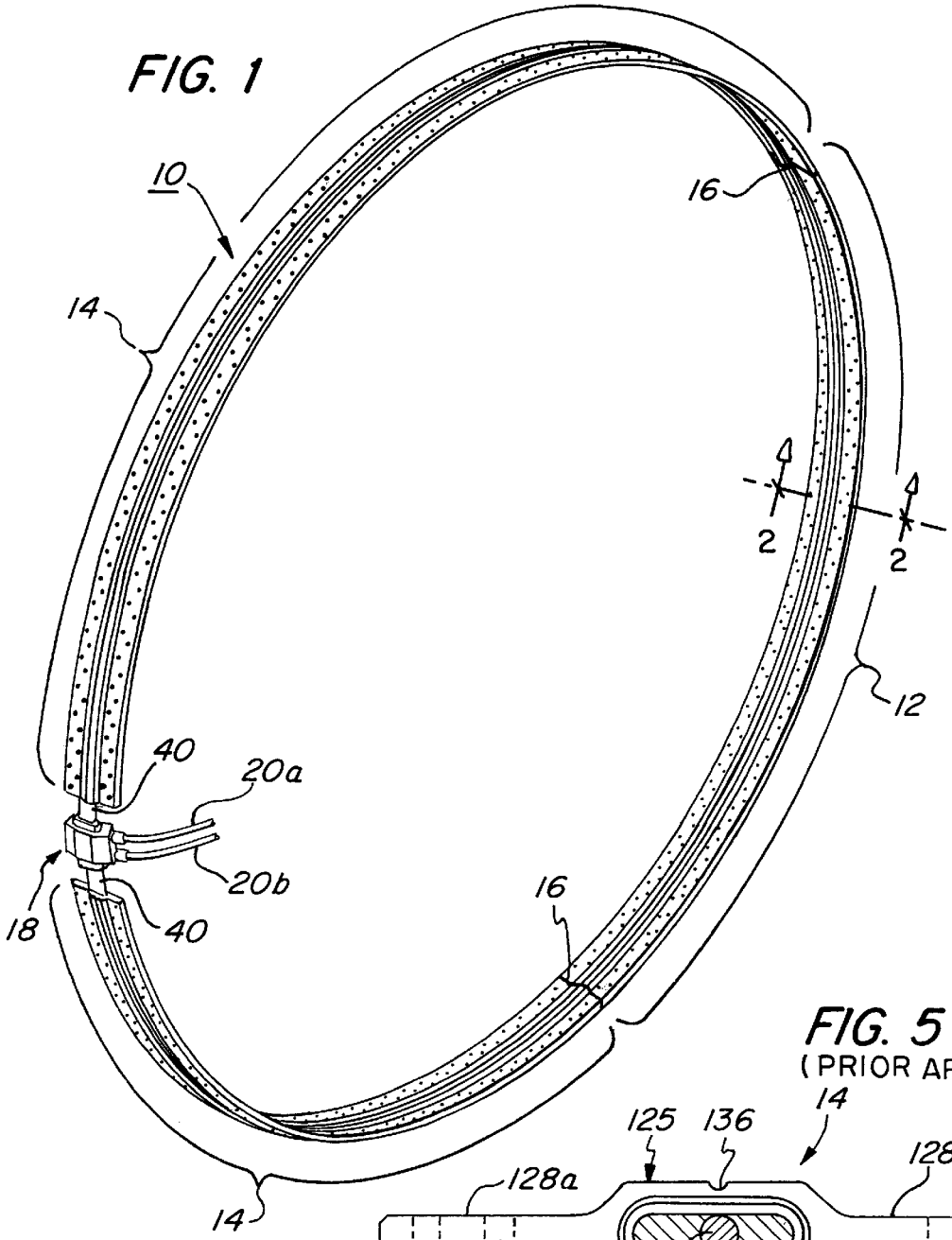
FIG. 5
(PRIOR ART)
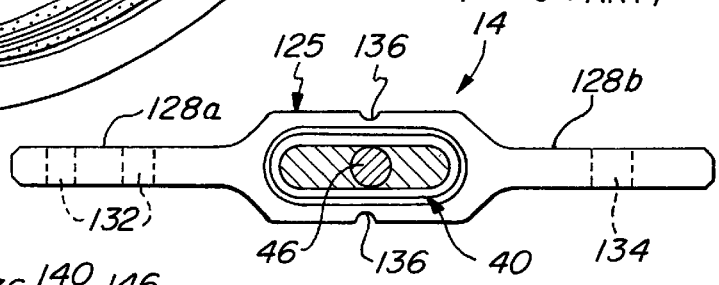
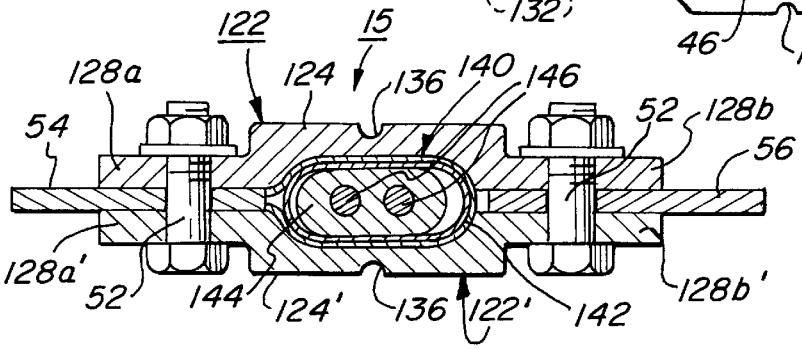
FIG. 6
(PRIOR ART)

FLAT-FORM SEPARATION DEVICES

CROSS-REFERENCE TO RELATED APPLICATION

This application claims the benefit of U.S. Provisional Patent Application No. 60/051,689, filed Jul. 3, 1997 and entitled "HIGH STRENGTH SEPARATION DEVICES".

BACKGROUND OF THE INVENTION

1. Field of the Invention

The present invention relates to flat-form separation devices of the type used to effect a separation of two structures, such as the stages of a multi-stage rocket, that are temporarily adjoined to one another by the separation device. Separation of the temporarily joined structures is attained by explosively rupturing a frangible joint which extends along the length of the separation device between the two joined structures.

2. Related Art

Such separation devices are well-known and typically comprise a frangible joint within which is disposed an expansion device. The frangible joint connects a pair of joinder flanges, respective ones of which extend along laterally opposite sides of the frangible joint. Typically, the frangible joint has a channel extending there-through and within which the expansion device is disposed. The frangible joint further has a pair of grooves extending along the exterior thereof, one opposite each side of the channel, to provide a fracture seam. The expansion device typically comprises a deformable containment tube (in those cases in which it is desired that the products of the rupturing explosion not contaminate the environment) within which an elastomeric charge holder supports a linear explosive charge, typically a mild detonating fuse. The joinder flanges are secured to respective structures that are eventually to be separated, e.g., fairings or field joint adapters on a rocket, missile or payload platform, and the frangible,joint holds the respective structures together until the frangible joint is ruptured by detonation of the linear explosive charge.

A separation device as described above and comprised of a pair of half-sections which are joined together to provide the separation device, but with portions of the joined structure interposed between the flanges of the half-sections, is disclosed in U.S. Pat. No. 3,698,281, entitled "EXPLOSIVE SYSTEM" and issued on Oct. 17, 1972, to O. E. Brandt et al.

U.S. Pat. No. 5,390,606, entitled "FRANGIBLE JOINT SEPARATION SYSTEM", issued on Feb. 21, 1995 to G. N. Harris and which refers to the Brandt et al U.S. Pat. No. 3,698,281, ascribes to it disadvantages including the necessity of forming two separate precision-machined rings to form the structure. In contrast, Harris U.S. Pat. No. 5,390,606 discloses the use of a single-piece, hollow-form extrusion to provide the frangible joint and joinder flanges of the separation device, the core of the hollow-form extrusion having the containment tube containing the linear explosive charge threaded therethrough.

U.S. Pat. No. 5,129,306, entitled "BREAKABLE JOINT SYSTEM ENABLING PARTS TO BE SEPARATED BY MEANS OF AN EXPLOSIVE CHARGE", issued on Jul. 14, 1992 to Gilbert Fauvel discloses a frangible joint system which, as illustrated in FIGS. 4 and 5 of the Fauvel Patent, comprises two half-sections described as an outer plate 21 and an inner plate 22 which are juxtaposed against each other to define between them a housing 23 for receiving an explosive fuse, i.e., an expansion device. The Fauvel Patent specifies that the edges of honeycomb structure parts 30, 31 are hollowed out to receive therein the ends of the joined half-sections which are fastened to the respective structures by bolts 25. The half-sections or plates 21, 22 are configured on their inside surfaces 21D and 22D with recesses so that when joined together a cavity 27 (FIG. 4) of substantially trapezoidal shape extends through the joined structure, as described starting at column 5, line 33 of the Fauvel Patent.

The respective structures of the Brandt et al, Harris and Fauvel Patents are discussed in more detail below.

SUMMARY OF THE INVENTION

In accordance with the present invention there is provided a flat-form separation device for connection to first and second separable structures comprising the following elements. First and second half-section members having respective longitudinal center axes are provided, each of the half-section members being comprised of (i) a longitudinally-extending half-joint segment having opposite lateral shoulders, an exterior side in which is formed a longitudinally-extending rupture groove, and a concave interior side, and (ii) a pair of half-flange segments, one of the half-flange segments extending from each lateral shoulder of the half-joint segment, each half-flange segment having a respective interior joining surface, and a respective exterior flange surface. The first and second half-section members are connected to each other with their respective interior-joining surfaces connected in facing relationship to each other so as to preclude interposition therebetween of elements of such first and second separable structures. In this way there are provided mating flange members which, when joined to each other, define opposite, first and second joinder flanges respectively dimensioned and configured for connection to respective first and second ones of such separable structures. The first and second half-section members are connected with their respective half-joint segments having their concave sides facing each other to define therebetween a receiving channel extending longitudinally through the separation device, the joined half-joint segments defining a frangible joint. The first and second half-flange segments are dimensioned and configured whereby, when connected to each other as defined above, the resulting flat-form separation device is of solid construction throughout and free of longitudinally extending interior channels or cavities other than the receiving channel. An expansion device comprising a linear explosive charge is disposed within and extends along the channel.

In one aspect of the invention, the flat-form separation device further comprises a rupture groove extending along the surface of the convex exterior side of each half-joint segment. With this construction, the frangible joint has one rupture groove extending longitudinally therealong on each opposite side thereof.

In one aspect of the present invention, the respective interior joining surfaces of each half-section member are in face-to-face abutting contact with each other.

In another aspect of the present invention, each of the half-flange segments has formed thereon a plurality of half-flange apertures, the apertures of mating flange members aligning with each other to provide a plurality of joinder flange apertures for use in connecting the joinder flanges to respective ones of such separable structures.

Yet another aspect of the present invention provides that the expansion device further comprises a deformable containment tube of generally oval cross-sectional configuration within which is disposed a holder containing the linear explosive charge.

Other aspects of the present invention provide that the flat-form separation device be made of a metal or metal alloy having a tensile strength greater than that of 6061 aluminum and greater than that of heat-treated, tempered 6061 aluminum. For example, the flat-form separation device may be made of an aluminum metal or alloy such as a 7075 aluminum alloy, or a titanium alloy or titanium.

Other aspects of the invention provide the flat-form separation device in the form of one or more segments thereof comprising part of a segmented separation structure which is further comprised of one or more segments of a hollow-form separation device. In such case, the hollow-form separation device preferably has a cross-sectional profile which is substantially identical to that of the flat-form separation device.

Another aspect of the invention provides for the width of the frangible joint to be greater than the width of either of the joinder flanges.

A further aspect of the invention provides that the flat-form separation device may also comprise a plurality of transverse apertures formed in the first and second half-section members and being dimensioned and configured to receive therein mechanical fasteners to connect the half-section members to each other.

Other aspects of the invention provide that the flat-form separation device further comprises a clevis member connected to at least one of the joinder flanges. At least one of the joinder flanges may also be dimensioned and configured to define a wedge. Optionally, the flat-form separation device further comprises a connector mounted to at least one of the joinder flanges and defining an opening which is generally arrowhead-shaped in cross section. Another option is for the flat-form separation device to further comprise a mounting bracket connected to at least one of the joinder flanges.

Other aspects of the invention provide for the flat-form separation device as further comprising spaced-apart interlocking members which may extend from each of a mating pair of half-flange segments and the interlocking members of the mating pairs may further be respectively dimensioned and configured to interlock upon the half-section members being connected to each other. The interlocking members may comprise contact surfaces for providing an interlocking fit therebetween. The contact surfaces may each be disposed at an acute angle to the longitudinal direction of the half-section members. The flat-form separation device may also comprise at least one end clip connected to the first and second half-section members for retaining the first and second half-section members together. In this embodiment, each end clip may comprise a tie member and a pair of retaining brackets wherein each retaining bracket is connected to a respective first and second half-section member and the tie member. The tie member and retaining brackets may also be dimensioned and configured to include engagement surfaces which are each disposed at an acute angle to the longitudinal direction of the first and second half-section members.

Still other aspects of the invention will be apparent from the following description and the appended drawings.

BRIEF DESCRIPTION OF THE DRAWINGS

FIG. 1 is a perspective view of a segmented separation structure in accordance with one embodiment of the present invention comprising segments of both flat-form and hollow-form separation devices;

FIG. 5 is a view corresponding to FIG. 2 but of a hollow-form separation device in accordance with the prior art;

FIG. 6 is a view corresponding to FIG. 2 but of another prior art separation device;

DETAILED DESCRIPTION OF SPECIFIC EMBODIMENTS OF THE INVENTION

Figure 4:
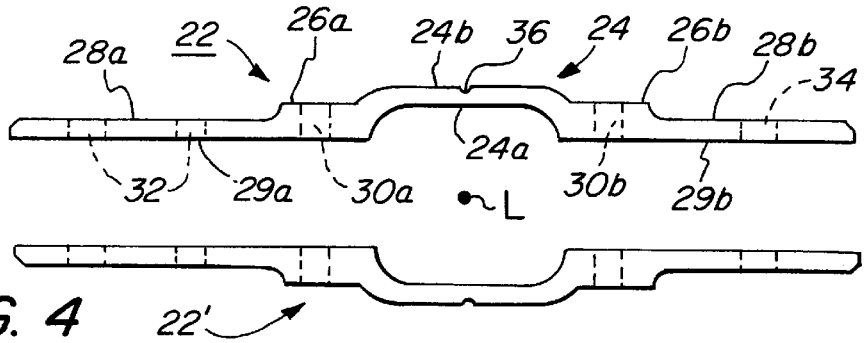
FIG. 4 is an exploded view of first and second half-sections comprising a portion of the flat-form separation device of FIG. 2.

FIG. 1 shows a segmented separation structure generally indicated at 10, having one segment thereof comprised of a flat-form separation device 12 in accordance with an embodiment of the present invention, with the remainder of the structure being comprised of a prior art hollow-form separation device 14. Seams 16 show the places at which separation devices 12 and 14 meet. A common expansion device 40 is threaded through the flat-form separation device 12 and the hollow-form separation devices 14, and its opposite ends are connected to a detonation manifold 18 in signal transfer communication with a pair of signal transfer lines 20*a*, 20*b* in a manner well known to those skilled in the art. For example, the above-mentioned Harris U.S. Pat. No. 5,390,606 discloses in FIG. 4 thereof one embodiment of a detonator manifold connected to the opposite ends of the containment tube of an expansion device.

Figure 2:
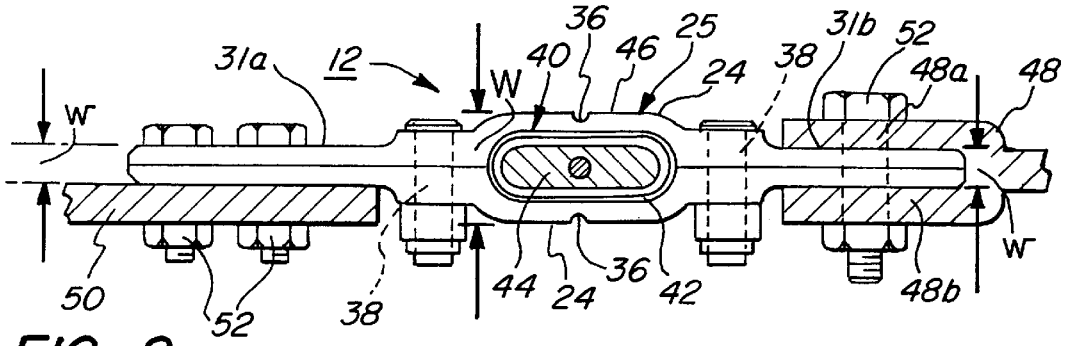
FIG. 2 is a cross-sectional view of a flat-form separation device, enlarged with respect to FIG. 1, taken along line 2—2 of FIG. 1 at a flat-form segment of the separation structure of FIG. 1.
Figure 3:
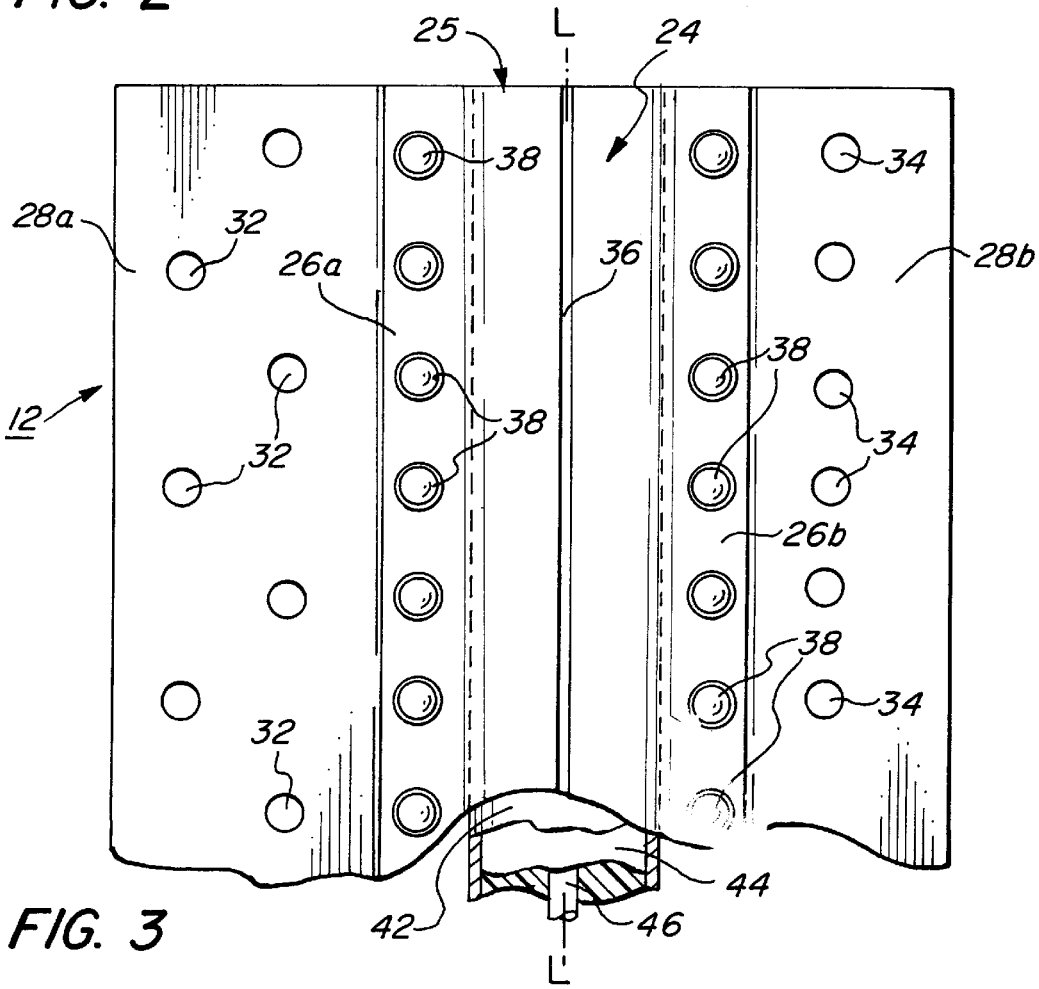
FIG. 3 is a partial plan view of the flat-form separation device of FIG. 2;.

Referring to FIGS. 2, 3 and 4, a pair of half-section members 22, 22' (FIG. 4) are seen to be identical in shape and therefore symmetrical about a center line longitudinal axis L—L (FIG. 3) when two pieces are brought into facing contact with each other as in the finished device. (In FIG. 4, axis L—L is shown as a dot, L.) Because each half-section member 22, 22' is identical, only the features of half-section member 22 are numbered in FIG. 2 and described in detail below. (A single length of half-section member 22 may be cut transversely, at a right angle to its longitudinal axis, and the two pieces rotated towards each other about the axis of the transverse cut so that the concave portions meet, to provide the arrangement of FIG. 2.) Half-section section 22 is comprised of a longitudinally extending half-joint segment 24 having a concave interior side 24*a*, and a convex exterior side 24*b*. The half-joint segment 24 terminates in respective opposite lateral shoulders 26*a* and 26*b*. From these lateral shoulders there extends in opposite facing directions a pair of half-flange segments 28*a* and 28*b*. Each of the lateral shoulders has extending therethrough a respective fastener aperture 30*a* and 30*b*. Half-flange segment 28*a* has extending therethrough a staggered array of first joinder flange apertures 32, and half-flange segment 28*b* has extending therethrough second joinder flange apertures 34. In the illustrated embodiment, second joinder flange apertures 34 are not staggered, but are presented in single file array. Rupture groove 36 extends longitudinally along the exterior surfaces 24*b* of half-joint segment 24.

Referring to FIG. 2, half-section members 22, 22' are seen assembled to each other by a plurality of fasteners 38, with half-flange segments 28*a*, 28*b* having their respective interiorjoining surfaces 29*a* and 29*b* in face-to-face abutting contact with each other whereby two sets of half-flange segments 28*a*, 28*b* are joined to define a pair of mounting flanges 31*a*, 31*b*. Obviously, the two half-section members 22, 22' could be joined by any suitable means, such as welding, brazing or riveting, or by use of any other suitable mechanical fastening means. Prior to so fastening half-section members 22, 22' to each other, an expansion device 40 would have been positioned between the concave interior sides 24*a* of the half-joint segments 24 so that expansion device 40 is enclosed within the channel (unnumbered) formed by the two half-joint segments 24 of the joined-together half-section members 22, 22'. Half-flange segments 28*a*, 28*b* are each dimensioned and configured to provide solid mounting flanges 31*a*, 31*b*, without openings or passageways formed thereon, except for mounting holes or apertures which are formed transversely of the half-flange segments and are to be occupied by mechanical fasteners such as the bolts 52 shown in FIG. 2 and described below. Similarly, aside from the receiving channel formed within frangible joint 25 by facing concave interior sides 24*a* to receive expansion device 40, frangible joint 25 is solid throughout except for transversely-positioned fastener apertures 30 which are to be occupied by the fasteners 38. It is thus seen that except for apertures to be occupied by mechanical fasteners and the channel which is occupied by expansion device 40, flat-form separation device 12 is of solid construction and is free of interior chambers, openings, channels or the like. This solid construction enhances the strength of flat-form separation device 12, increasing its strength as compared to prior art devices of the same dimensions, or permitting the use of a separation device of given dimensions which is as strong or stronger than larger or thicker prior art devices.

The two joined half-joint segments 24 with grooves 36 thereon comprise frangible joint 25. Expansion device 40 is of conventional construction, and comprises a containment tube 42 which is of oval "racetrack" configuration, and within which is encased a holder 44, typically made of rubber or some other elastomer, which retains in place a linear explosive charge comprising, in the illustrated embodiment, a mild detonating fuse 46. It will be noted that rupture grooves 36 are positioned on opposite sides of mild detonating fuse 46 and are co-extensive therewith, as is best appreciated from FIG. 3.

FIG. 2 shows a portion of a first structure 48 and a second structure 50, structures 48, 50 being temporarily joined by flat-form separation device 12. The end of the bulkhead of structure 48 is of clevis shape so that the flange formed by half-flange segments 28*b* fits within the legs 48*a*, 48*b* of first structure 48 and is secured thereto by a series of bolt fasteners 52, only one of which is visible in FIG. 2. Although normally the bulkheads of the support structures to be connected would be identical and are preferably of clevis shape as illustrated with respect to first structure 48, section structure 50 is shown, for purposes of illustration, as being of a different, single-wall design and is connected to one side of the flange formed by half-flange segments 28*a* and is secured thereto by a bolt fastener 52. Accordingly, preferably both, but at least one, of the exterior flange surfaces of each joinder flange is dimensioned and configured to abut a surface of first and second structures 48, 50.

In its preferred construction as shown in FIG. 2, the width W of frangible joint 25 is greater than the width w of either of mounting flanges 31 a, 31*b*. This enables the placement of the mounting flanges within a relatively narrow clevis-like opening as is provided by first structure 48 in FIG. 2. Even when mounted against an exterior surface, such as that provided by second structure 50 in FIG. 2, a relatively thin silhouette is provided by the strong, solid construction of the mounting flanges 31*a*, 31*b*. This is advantageous because of space limitations often encountered in areas of use of separation devices.

FIG. 5 shows a prior art hollow-form separation device 14, which is incorporated into the segmented separation structure 10 illustrated in FIG. 1. Accordingly, it has threaded therethrough the same expansion device 40 illustrated in FIGS. 1 and 2. The hollow-form separation device 14 comprises a single, unitary extruded member whose cross-sectional profile is selected to be identical to that of flat-form separation device 12. Hollow-form separation device 14 has rupture grooves 136 which, in the segmented separation structure of FIG. 1, will be aligned with, respectively rupture grooves 36 of flat-form separation device 12. Rupture grooves 136 are formed in frangible joint 125. Similarly, hollow-form separation device 14 has a pair of flanges 128*a*, 128*b*. Flange 128*a* has a series of staggered first joinder flange apertures 132 formed therein, and flange 128*b* has a series of secondjoinder flange apertures 134 formed therein. Apertures 132 and 134 are sized and arranged in a pattern identical to that of apertures 32 and 34 of separation device 12. Generally, because it is manufactured by an extrusion process, the alloy of which hollow-form separation device 14 is made will be weaker than the alloy of which the flat-form separation device 12 is made.

Because the half-section members 22, 22' need not be formed by extrusion, as is the case with the hollow-form separation devices 14 as shown in the prior art device of FIG. 5, half-section members 22, 22' may be made of metals or alloys which are harder and tougher, and have considerably higher tensile strength, than alloys such as 6061 aluminum alloy, which is capable of being extruded to provide a hollow-form separation device, as shown in the prior art device of FIG. 5. A hollow-form extrudable alloy such as 6061 aluminum is of significantly lower strength than other metals or alloys which, while they cannot be extruded as hollow-form devices, may be produced by other methods, such as machining from metals or alloys such as titanium, titanium alloys and higher tensile strength aluminums, such as 7075 aluminum alloy. Because of this, separation devices in accordance with the present invention possess considerably higher tensile strength than hollow-form separation devices of similar or identical size and profile. Therefore, the flat-form separation devices of the present invention are capable of supporting much higher loads, and better withstanding the vibration and stresses of flight, than comparably sized hollow-form separation devices. Further, the flat-form separation devices of the present invention, because they may be fabricated to have an identical cross-sectional profile to hollow-form separation devices such as those illustrated in FIG. 5, may be substituted for lengths of less expensive but weaker hollow-form separation devices at critical, high stress, high load locations along the structures joined by the separation devices. Thus, as illustrated in FIG. 1, the segmented separation structure therein illustrated is designed to connect two structures to each other, which will undergo loads and stresses which are higher along the portion of the separation structure 10 comprised of flat-form separation device 12, than they are along portions of separation device structure 10 comprised of the prior art hollow-form separation devices 14.

In another embodiment, a number of segments of the flat-form separation device of the present invention may be substituted at critical portions for the less expensive, but weaker, hollow-form separation devices.

Obviously, in still another embodiment, the entire separation structure 10 may be comprised of the flat-form separation device of the present invention. Such construction would provide higher strength for a given weight of separation structure, or a smaller, lighter separation structure of equivalent strength, as compared to the hollow-form separation devices of the prior art. Another advantage of utilizing the flat-form separation devices of the present invention is that the expansion device (40 in FIG. 2) is more easily installed, as it may be placed into the groove formed by the interior concave surface 24*a* of one of the half-joint segments 24, prior to the other half-joint segment being bolted into place thereover. This avoids the necessity of threading the expansion device through the entire length of a prior art hollow-forn separation device. Further, once the half-section members are bolted together, the separation device of the present invention may be installed as a single unit on the vehicles or other parts to be temporarily joined, which simplifies and speeds up the installation procedure as compared to prior art devices in which the two half-section members and expansion device must each be installed separately.

The prior art device of FIG. 6 is shown connected by bolt fasteners 52 to bulkheads 54 and 56 of, respectively, two different structures which are to be temporarily joined by the prior art separation device 15. Prior art separation device 15 is comprised of two half-section members 122, 122' to provide half-joint segments 124, 124' and spaced-apart half-flange segments 128*a* and 128*a*', and 128*b* and 128*b*'. Expansion device 140 comprises a containment tube 142 and a holder 144 and, in this case, is illustrated as having a pair of mild detonating fuses 146 extending therethrough.

Figure 7:
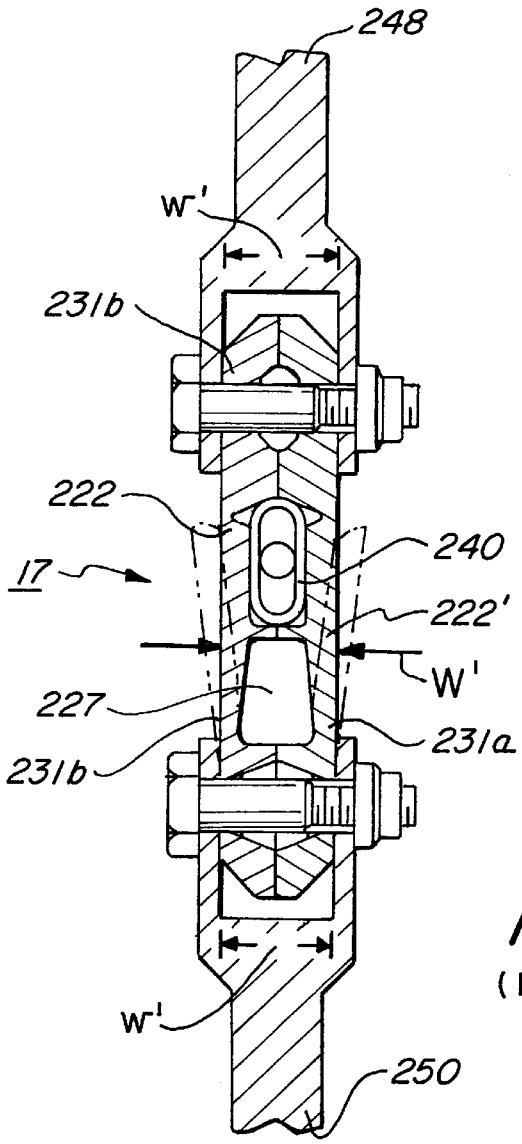
FIG. 7 (PRIOR ART)
FIG. 7 is a view corresponding to FIG. 2 but of a third prior art separation device.
Figure 8:
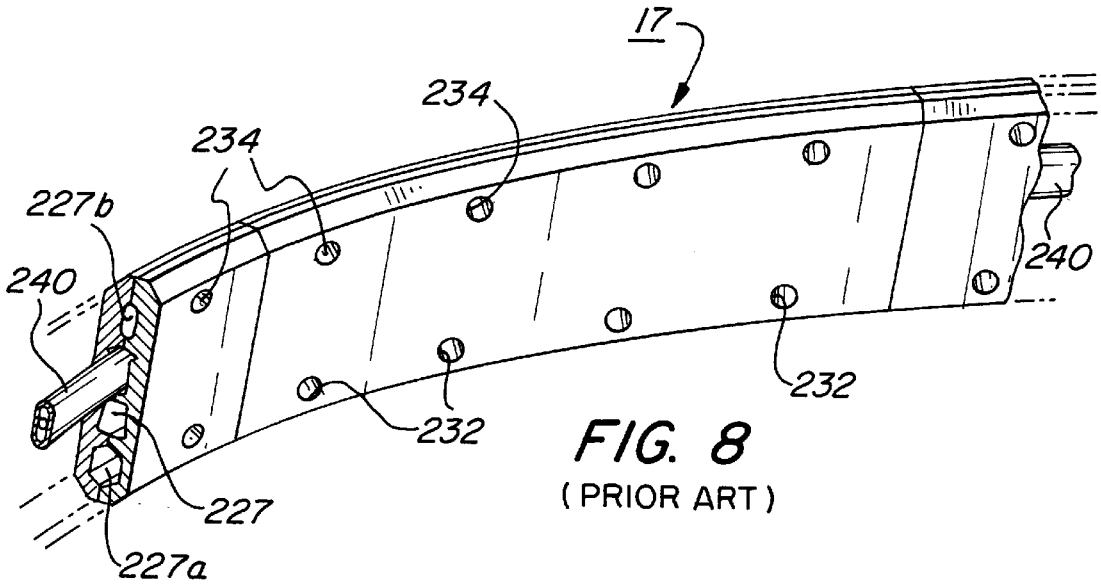
FIG. 8 (PRIOR ART)
FIG. 8 is a perspective view of the prior art separation device of FIG. 7.

The prior art device illustrated in FIG. 7 shows a separation device 17 formed of a pair of half-section members or plates 222, 222' which, when joined together, define a receiving channel (unnumbered) within which an expansion device 240 is received. The device joins separable structures 248, 250. The mounting flanges 231*a*, 231*b* are seen to be of identical width W' to the width w' of the frangible joint 225, and have recesses formed therein so that when the two half-section members are joined, a cavity 227 is formed which extends throughout the member. Additional cavities 227*a* and 227*b* are formed to extend through the member, as best seen in FIG. 8, with the transverse apertures 232, 234 extending therethrough. The cavity 227 is stated to reduce the mass of the plates and create zones of weakness along flanges 231*a* and 231*b* (FIG. 7), so that when the explosive is detonated, the walls will pivot outwardly as indicated by dash lines in FIG. 7.

Although prior art separation devices such as those illustrated in FIG. 6 also have a flat-form configuration, i.e., they can be machined or otherwise made by techniques other than the extrusion process required for hollow-form separation devices, they suffer from the disadvantage that the profile of such structure would be different from the cross-sectional profile of a hollow-form device such as that illustrated in FIG. 5. This follows from the necessity, when using the FIG. 6 separation device, of interposing a portion of the separate structures to be joined between the half-flanges of the separation device. This is not compatible with the necessity of mounting the separate structures against the exterior surface or surfaces of the solid flanges of the hollow-form device. Such difference in cross-sectional profile would render it difficult, if not impossible, to substitute one or more sections configured as in FIG. 6, along the length of a separation structure comprised of a hollow-form separation device, such as that of FIG. 5. The interposition between the half-flanges of bulkheads 54 and 56, or other structural portions of the structures to be temporarily joined by the separation device of FIG. 6, results in necessarily spacing apart the two half-sections. This leaves the channel (unnumbered) within which the expansion device 140 is contained, open at the ends thereof opposite the respective edges of the interposed bulkheads 54 and 56, leaving opposite edges of the containment tube 142 unsupported.

Further, three separate pieces, the half-section members 122, 122' and expansion device 140 must be assembled on site, at the vehicles or parts to be joined. This contrasts with the one-piece pre-assembled separation device attainable with the present invention. The prior art device of FIGS. 7 and 8 also requires the on-site assembly of three different pieces, plates 222, 222' and expansion device 240.

Figure 9:
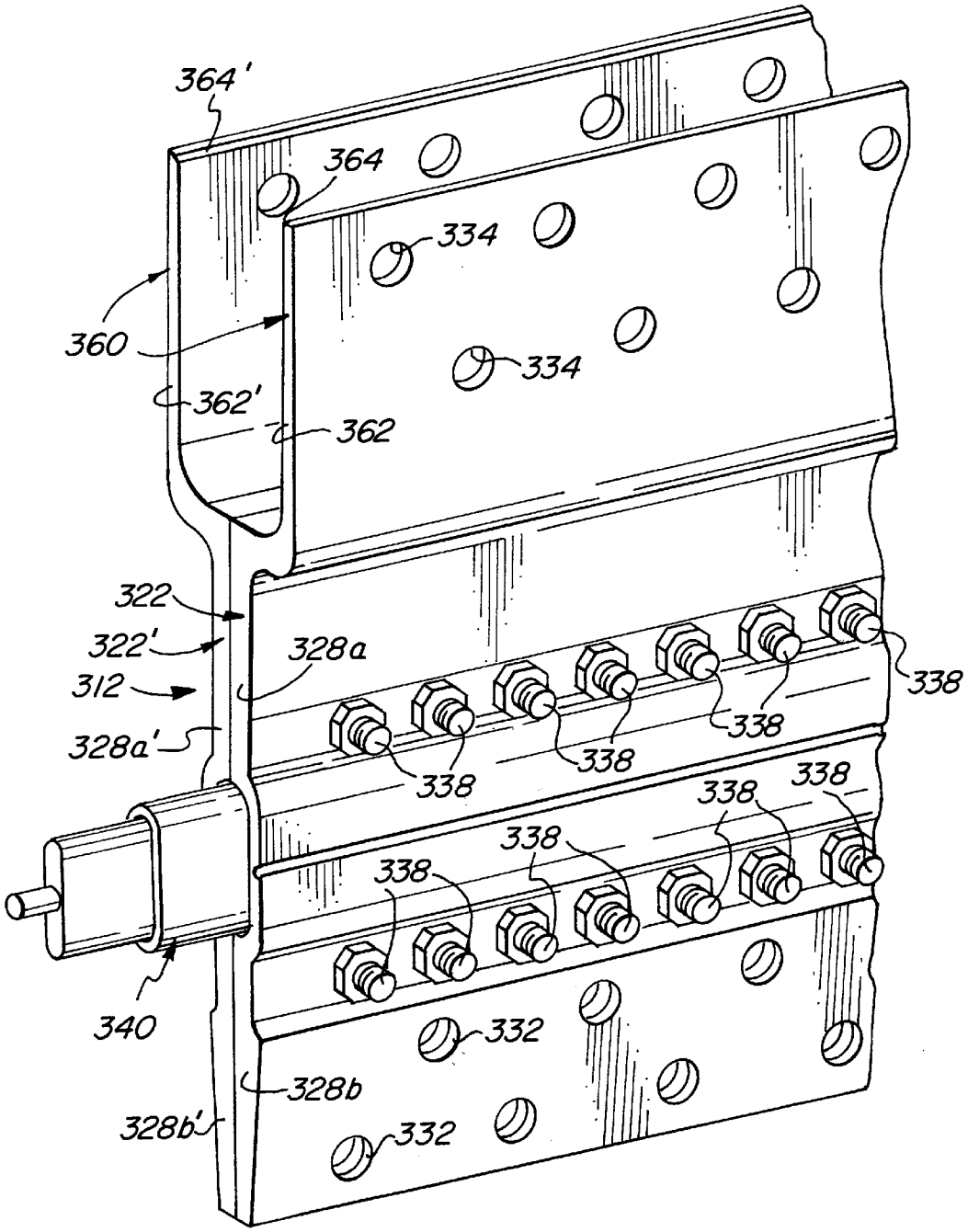
FIG. 9 is a partial perspective view of a second embodiment of a flat-form separation device in accordance with the present invention.
Figure 10:
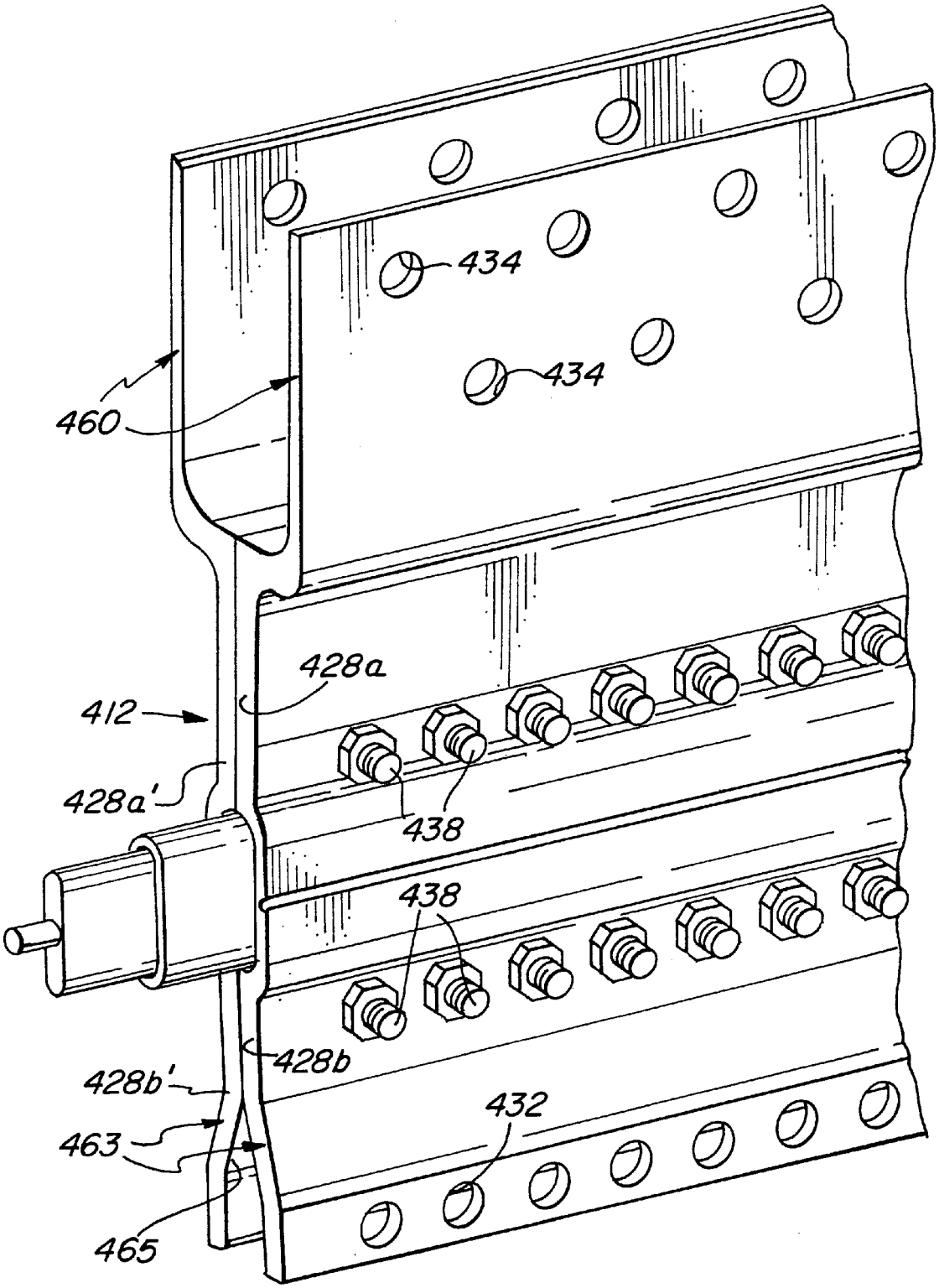
FIG. 10 is a partial perspective view of a third embodiment of a flat-form separation device in accordance with the present invention.
Figure 11:
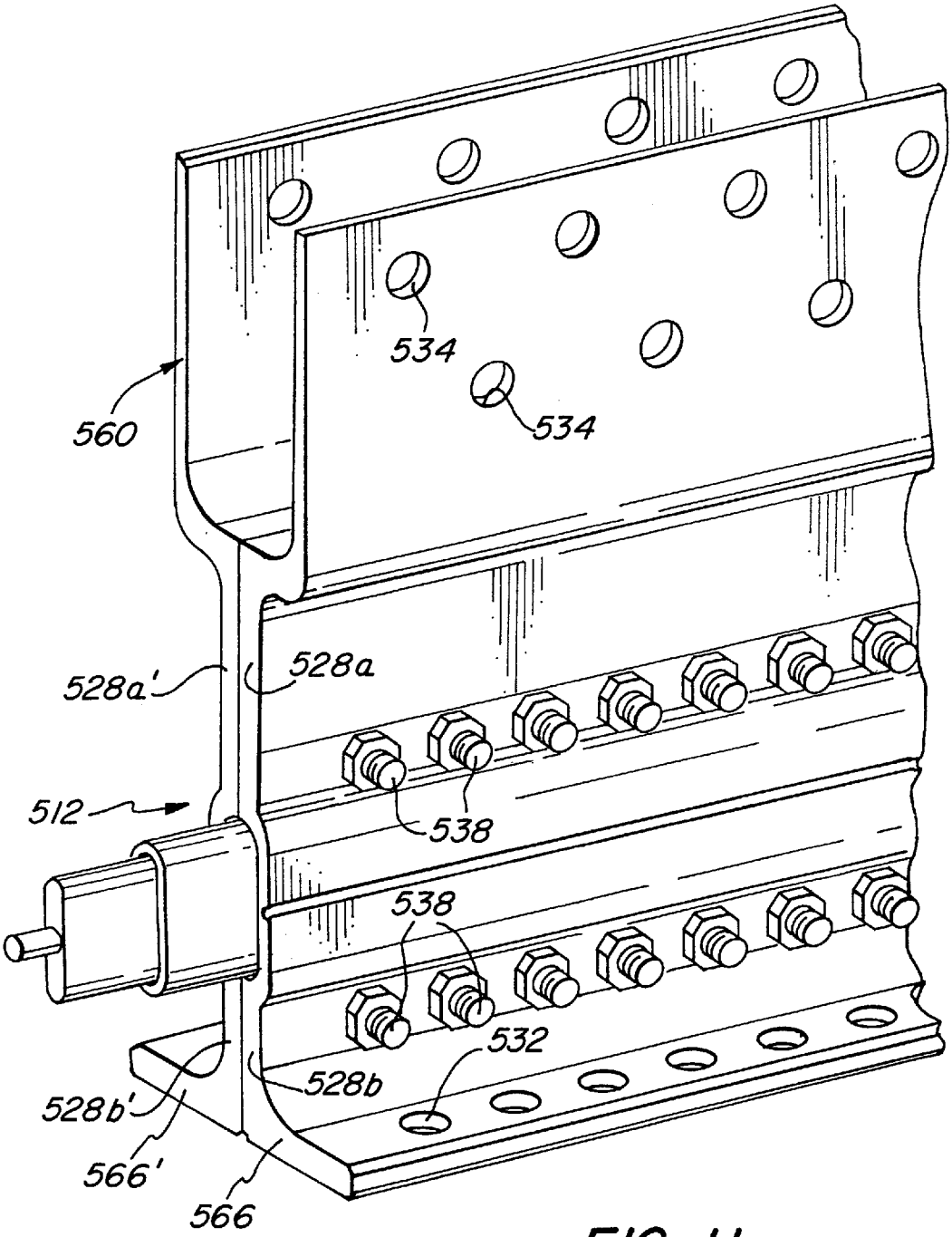
FIG. 11 is a partial perspective view of a fourth embodiment of a flat-form separation device in accordance with the present invention.

FIGS. 9–11 illustrate several additional embodiments of the present invention which provide features which enable the flat-form separation devices to accommodate different structural loads and interconnection arrangements encountered in various applications in which the flat-form devices of the present invention are utilized.

FIG. 9 illustrates one such embodiment of a flat-form separation device, shown generally at 312, which includes half-section members 322, 322' having half-flange segments 328*a*, 328*b*, 328*a*', 328*b*', apertures 332,334 and fasteners 338, all of which may be similar to those previously described with respect to FIG. 4. In accordance with this embodiment of the present invention, half-flange segments 328*b*, 328*b*' are tapered on the exterior sides thereof so that they are narrower at their outer, distal edges than at the inner portions. In the illustrated embodiment, the half wedge-like half-flange segments 328*b*, 328*b*' cooperate, when assembled as shown in FIG. 9, to form a wedge-like configuration. The wedge-like shape, e.g., eases insertion of the assembly into a correspondingly configured mating structure (not shown). It will be appreciated that only one of the half-flange segments 328*b*, 328*b*' may be configured to form a wedge.

FIG. 9 also illustrates a clevis member 360 located on the side of the expansion device 340 opposite from the wedge-like half-flange segments 328*b*, 328*b*'. The clevis member 360 includes a pair of clevis brackets 362 and 362', each of which may be advantageously integrally formed with the half-section members 322, 322'. Chamfered surfaces 364, 364' may also be provided for ease in assembly of the device. It will be understood that the clevis member 360 and wedge-like half-flange segments 328*b*, 328*b*' need not necessarily be provided in the same separation device but are independently utilizable features. It will be appreciated that only one of half-flange segments 328*a*, 328*a*' may be configured to form a clevis member (not shown).

FIG. 10 shows another embodiment of a flat-form separation device 412 which includes half-flange segments 428*a*, 428*b*, 428*a*', 428*b*', apertures 432, 434 and fasteners 438, all of which may be similar to that described above with respect to FIG. 4. In this embodiment, a connector 463 is provided which is configured to define an opening 465 which, in the illustrated embodiment, is generally arrowhead-shaped in cross-section. In this way, a correspondingly shaped mating structure (not shown) may be mounted between half-flange segments 428*b* and 428*b*'. The flat-form separation device 412 is, in the illustrated embodiment, provided with a clevis member 460 similar to that previously described in FIG. 9.

Yet another embodiment of the flat-form separation device of the present invention is shown generally at 512 in FIG. 11 and includes half-flange segments 528*a*, 528*b*, 528*a*', 528*b*', apertures 532, 534 and fasteners 538, all of which may be similar to those described above with respect to FIG. 4. As shown in FIG. 11, half-flange segments 528*b* and 528*b*' include mounting brackets 566, 566' which may extend, as illustrated, perpendicular to the longitudinal direction of the flat-form separation device 512. The mounting brackets 566, 566' may be assembled to, for example, flat structure (not shown). It will be understood that the mounting brackets, optionally, may not extend perpendicularly depending upon the particular structural interconnection encountered. The illustrated flat-form separator 512 includes a clevis member 560 similar to that previously described in connection with FIG. 9.

Figure 12:
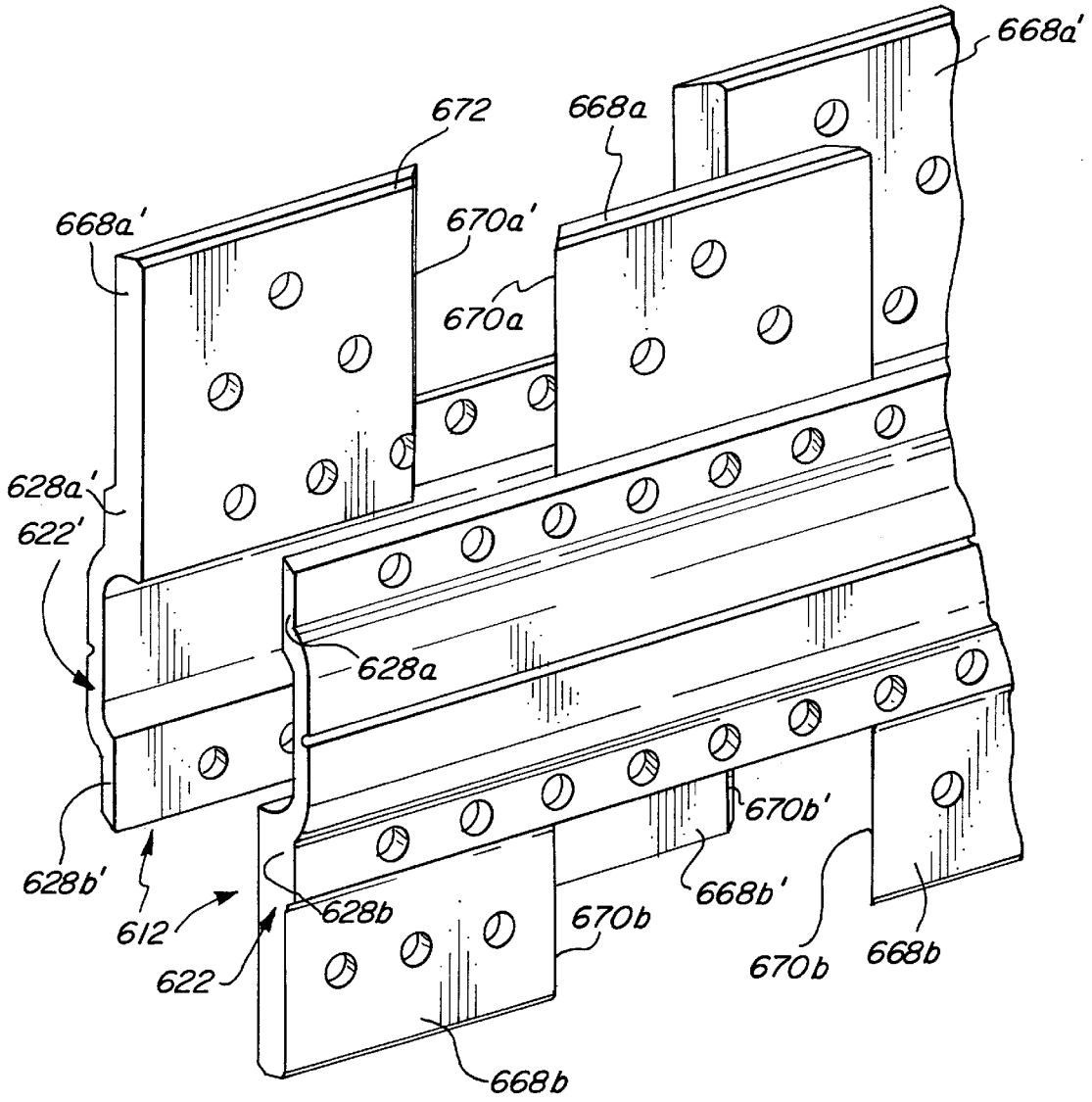
FIG. 12 is a partial perspective view of a fifth embodiment of a flat-form separation device in accordance with the present invention.

FIG. 12 illustrates another embodiment of a flat-form separation device of the present invention which is shown generally at 612. Each half-section member 622, 622' comprises spaced-apart interlocking members 668*a*, 668*b*, 668*a*', 668*b*' which may extend in an alternating fashion from each respective half-flange segment 628*b*, 628*a* and 628*a*', 628*b*'. Each of the interlocking members 668*a*, 668*b*, 668*a*' or 668*b*' may be provided with contact surfaces 670*a*, 670*b*, 670*a*', 670*b*' which may be angled at an acute angle to the longitudinal direction of the half-section members 622, 622' to provide an interlocking fit when the half-section members 622, 622' are assembled together. The edges of the interlocking members 668*a*, 668*b*, 668*a*', 668*b*' may also be chamfered as at 672, e.g., to facilitate assembly thereof.

Figure 13:
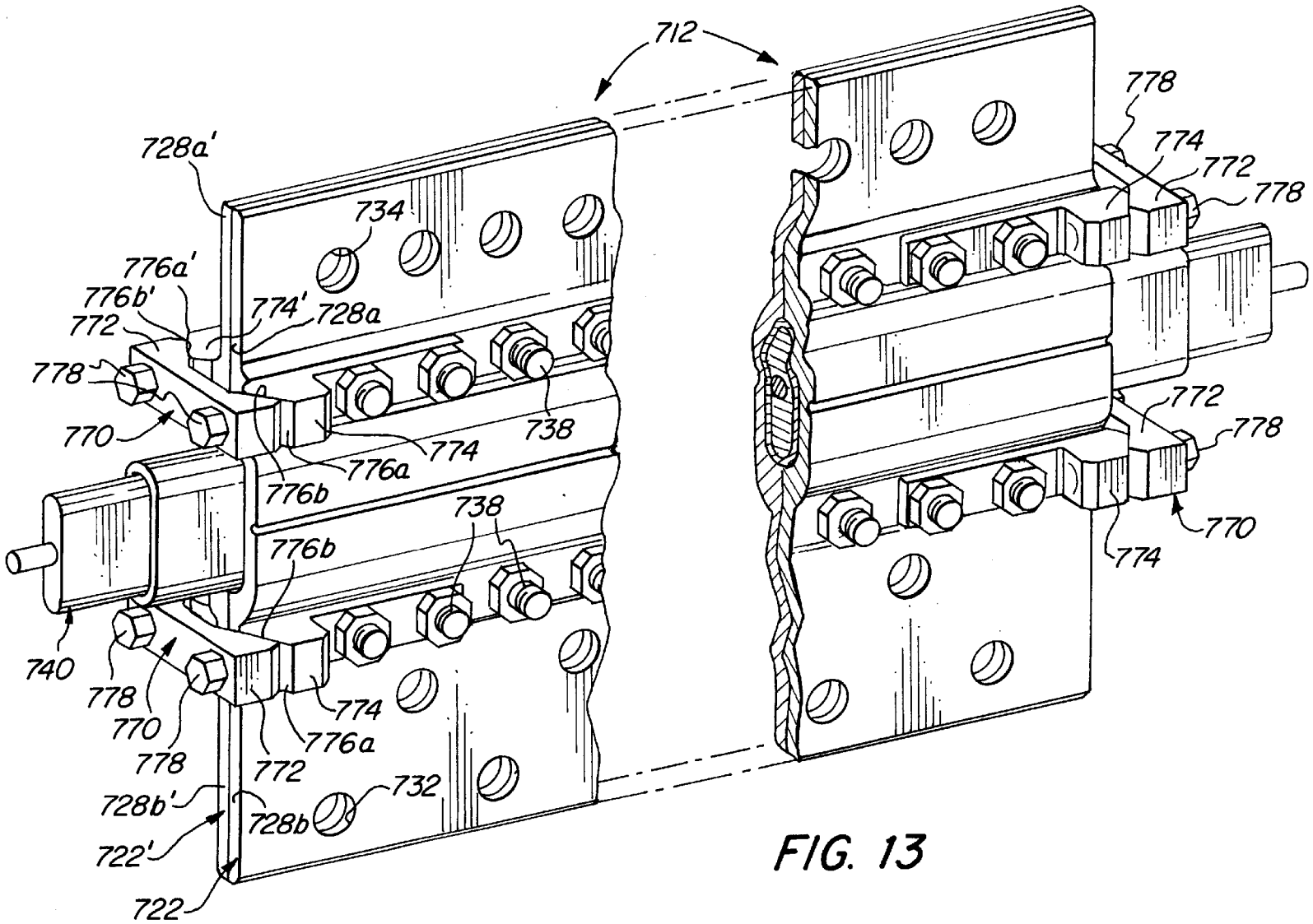
FIG. 13 is a partial perspective view of a sixth embodiment of a flat-form separation device in accordance with the present invention.

FIG. 13 illustrates a further embodiment of the flat-form separation device of the present invention, shown generally at 712 and comprising half-section members 722, 722', half-flange segments 728*a*, 728*b*, 728*a*', 728*b*', apertures 732, 734 and fasteners 738, all of which may be similar to those described above with respect to FIG. 4. In accordance with this embodiment, flat-form separator 712 includes end clips 770 disposed transversely of the half-flange segments 728*a*, 728*b*, 728*a*', 728*b*'. The end clips 770 function to retain respective paired half-flange segments 728*a*, 728*a*' and 728*b*, 728*b*' together, including during detonation of the expansion device 740. Each end clip 770 includes a tie member 772 and a pair of retaining brackets 774, 774'. The tie member and retaining brackets may be formed of any suitably strong and durable material such as a metal and are provided with matching engagement surfaces 776*a*, 776*b*, 776*a*', 776*b*'. Each of the engagement surfaces may be disposed at acute angles to the longitudinal direction of the half-section members 722, 722', e.g., for reducing shear stress on fasteners 778 during initiation of the expansion device 740.

While the invention has been described in detail with respect to specific preferred embodiments thereof, it will be apparent that upon a reading and understanding of the foregoing, numerous variations thereto may occur to those skilled in the art, which variations nonetheless lie within the scope of the appended claims.

What is claimed is:

1. A flat-form separation device for connection to first and second separable structures, comprising:

(a) first and second half-section members having respective longitudinal center axes, each of the half-section members comprising (i) a longitudinally-extending half-joint segment having a convex side in which is formed a longitudinally-extending rupture groove, and a concave side, and (ii) a pair of half-flange segments extending laterally from the half-joint segment;

(b) means for fastening together the first and second half-section members without fastening the device to such first and second structures;

(c) the first and second half-section members being fastened together with their concave sides facing each other to provide a frangible joint and to define therewithin one longitudinal channel without other cavities and further with their half-flange segments joined to provide opposite first and second flanges respectively dimensioned and configured for connection to such first and second structures; and (d) an expansion device comprising a linear explosive charge disposed within and extending along the channel.

2. The flat-form separation device of claim 1 wherein respective interior joining surfaces of the half-section members are in abutting contact with each other.

3. The flat-form separation device of claim 1 or claim 2 wherein each of the half-flange segments has formed thereon a plurality of half-flange apertures, the apertures of joined half-flange segments aligning with each other to provide a plurality of flange apertures for use in connecting the flanges to such first and second separable structures.

4. The flat-form separation device of claim 1 or claim 2 wherein the expansion device further comprises a deformable containment tube of generally oval cross-sectional configuration within which is disposed a holder containing the linear explosive charge.

5. The flat-form separation device of claim 1 or claim 2 made of a metal or metal alloy having a tensile strength greater than that of 6061 aluminum and greater than that of heat-treated, tempered 6061 aluminum.

6. The flat-form separation device of claim 5 wherein the metal or metal alloy comprises aluminum metal or alloy.

7. The flat-form separation device of claim 1 or claim 2 made of a 7075 aluminum alloy.

8. The flat-form separation device of claim 1 or claim 2 made of titanium or a titanium alloy.

9. The flat-form separation device of claim 1 or claim 2 wherein the width of the frangible joint is greater than the width of either of the first or second flanges.

10. The flat-form separation device of claim 1 wherein the means for fastening comprises a plurality of transverse apertures formed in the first and second half-section members, the transverse apertures being dimensioned and configured to receive therein mechanical fasteners to join the half-section members to each other and a plurality of mechanical fasteners disposed therein.

11. The flat-form separation device of claim 1 further comprising a clevis member connected to at least one of the flanges.

12. The flat-form separation device of claim 1 or claim 11 wherein at least one of the flanges is dimensioned and configured to define a wedge.

13. The flat-form separation device of claim 1 or claim 11 further comprising a connector mounted to at least one of the flanges and defining an opening which is generally arrowhead-shaped in cross section.

14. The flat-form separation device of claim 1 or claim 11 further comprising a mounting bracket connected to at least one of the flanges.

15. The flat-form separation device of claim 1 further comprising spaced-apart interlocking members extending from each of a mating pair of half-flange segments, the interlocking members of the mating pairs being respectively dimensioned and configured to interlock upon the half-section members being connected to each other.

16. The flat-form separation device of claim 15 wherein the interlocking members comprise contact surfaces for providing an interlocking fit therebetween.

17. The flat-form separation device of claim 16 wherein the contact surfaces are each disposed at an acute angle to the longitudinal direction of the first and second half-section members.

18. The flat-form separation device of claim 1, claim 11 or claim 15 further comprising at least one end clip connected to the first and second half-section members for retaining the first and second half-section members together.

19. The flat-form separation device of claim 18 wherein each end clip comprises a tie member and a pair of retaining brackets and wherein each retaining bracket is connected to a respective first and second half-section member and the tie member.

20. The flat-form separation device of claim 19 wherein the tie member and the retaining brackets are dimensioned and configured to include engagement surfaces which are each disposed at an acute angle to the longitudinal direction of the first and second half-section members.

21. An improved separation device for connection to first and second separable structures, the improvement comprising:

that at least one portion of the device comprises (a) first and second half-section members having respective longitudinal center axes, each of the half-section members comprising (i) a longitudinally-extending half-joint segment having a convex side in which is formed a longitudinally-extending rupture groove, and a concave side, and (ii) a pair of half-flange segments extending laterally from the half-joint segment, (b) means for fastening together the first and second half-section members without fastening the device to such first and second separable structures, (c) the first and second half-section members being fastened together with their concave sides facing each other to provide a frangible joint and to define therewithin one longitudinal channel without other cavities, and further with their half-flange segments joined to provide opposite first and second flanges respectively dimensioned and configured for connection to such first and second separable structures, and (d) an expansion device comprising a linear explosive charge disposed within and extending along the channel.

22. A separation structure for connection to first and second separable structures, the separation structure comprising:

at least one flat-form separation device in accordance with claim 1; and at least one separation device comprising a frangible joint having third and fourth longitudinally-extending rupture grooves disposed one on each side, and further comprising opposite third and fourth flanges respectively dimensioned and configured for connection to such first and second separable structures, and further comprising a second longitudinal channel with an expansion device therein.

* * * * *

UNITED STATES PATENT AND TRADEMARK OFFICE

CERTIFICATE OF CORRECTION

PATENT NO. : 6,125,762
DATED : October 3, 2000
INVENTOR(S) : Fritz et al.

It is certified that error appears in the above-identified patent and that said Letters Patent is hereby corrected as shown below:

Title page,
Abstract,
Line 7, replace "extraded" eith -- extruded --.

Column 5,
Lines 18-19, replace "interiorjoining" with -- interior joining --.

Column 6,
Line 6, replace "section" with -- second --;
Line 16, replace "31 a" with -- 31a --;
Line 40, replace "secondjoinder" with -- hollow-form --.

Column 7,
Line 33, replace "hollow-forn" with -- hollow-form --.

Column 9,
Line 28, "replace "separator" with -- separation device --;
Line 51, "replace" separator" with -- separation device --.

Signed and Sealed this

Twenty-third Day of October, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,125,762
DATED : October 3, 2000
INVENTOR(S) : Fritz et al.

It is certified that error appears in the above-identified patent and that said Letters Patent is hereby corrected as shown below:

Title page,
Item [57], ABSTRACT,
Line 17, replace “extraded” with -- extruded --

Column 5,
Lines 18-19, replace “interiorjoining” with -- interior joining --

Column 6,
Line 6, replace “section” with -- second --
Line 16, replace “31 a” with -- 31a --
Line 40, replace “secondjoinder” with -- hollow-form --

Column 7,
Line 33, replace “hollow-forn” with -- hollow-form --

Column 9,
Lines 28 and 51, replace “separator” with -- separation device --

Signed and Sealed this

Sixth Day of July, 2004

JON W. DUDAS
*Acting Director of the United States Patent and Trademark Office*